US005918871A

United States Patent [19]

Saito et al.

[11] Patent Number: 5,918,871

[45] Date of Patent: Jul. 6, 1999

[54] SHEET SORTER WITH STAPLER

[75] Inventors: Hiroshi Saito; Naoto Mochizuki, both of Yamanashi-ken; Hideharu Yoneoka; Shigeki Fukai, both of Tokyo, all of Japan

[73] Assignees: Nisca Corporation, Yamanashi-ken; Riso Kagaku Corporation, Tokyo, both of Japan

[21] Appl. No.: 08/855,636

[22] Filed: May 13, 1997

[30] Foreign Application Priority Data

May 13, 1996 [JP] Japan ..... 8-117513
Mar. 12, 1997 [JP] Japan ..... 9-57299

[51] Int. Cl.[6] ..... B65H 37/04

[52] U.S. Cl. ..... 270/58.11; 270/58.08

[58] Field of Search ..... 270/58.16, 58.17, 270/58.11, 58.14, 58.13, 58.12; 399/408; 220/58.07, 58.08

[56] References Cited

U.S. PATENT DOCUMENTS 4,925,172 5/1990 Christy et al. ..... 270/58.12
5,064,181 11/1991 Hosoi et al. ..... 270/58.08
5,385,340 1/1995 Hiroi et al. ..... 270/58.13
5,409,202 4/1995 Naramore et al. ..... 270/58.12
5,662,318 9/1997 Harada et al. ..... 270/58.11

*Primary Examiner*—H. Grant Skaggs
*Assistant Examiner*—Patrick Mackey
*Attorney, Agent, or Firm*—Sixbey, Friedman Leedom & Ferguson; Gerald J. Ferguson, Jr.; Donald R. Studebaker

[57] ABSTRACT

A sheet sorter with a stapler includes a plurality of bins arranged in a vertical direction each of which receives a plurality of sheets discharged from an and forms thereon a stack of sheets. An indexer receives the sheets from the image recording apparatus and distributes the sheets to the respective bins through the sheet inlet ends thereof. A stapler is movable up and down along the array of the sheet inlet ends of the bins and in a direction of width of the sheets to staple the stack of sheets on each bin which has been ejected beyond the sheet inlet end of the bin by a predetermined length. A single reciprocal pusher member is actuated after completion of stapling by the stapler and pushes the stapled stack of sheets back to the bin. A centering mechanism moves the reciprocal pusher member to a position substantially opposed to the middle of the trailing edge of the stack of sheets before the reciprocal pusher member is actuated.

5 Claims, 14 Drawing Sheets

STAPLING PROCESSING

SHEET SORTER WITH STAPLER

BACKGROUND OF THE INVENTION

1. Field of the Invention

This invention relates to a sheet sorter with a stapler, and more particularly to a sheet sorter which is provided with a plurality of bins each of which receives a plurality of sheets discharged from an image recording apparatus such as a printer, a copier or the like and forms thereon a stack of sheets, and a stapler for stapling or binding the sheet stack on each bin.

2. Description of the Related Art

As disclosed, for instance, in Japanese Unexamined Patent Publication No. 4(1992)-43089, there has been known a sheet sorter in which a plurality of recorded sheets discharged from an image recording apparatus such as a printer, a copier or the like are distributed to a plurality of bins or sort trays in sequence to form a stack of sheets on each bin by a sheet distributor called an indexer and when the number of the sheets stacked on each of the bins reaches a predetermined value, the sheet stack on each of the bins is stapled by a stapler which is movable up and down along the array of the sheet inlet ends of the bins and in a horizontal direction along the edge of each bin (direction of width of the sheets).

Accordingly when stapling the sheet stack, it is necessary to eject the sheet stack on selected one of the bins toward the stapler beyond the sheet inlet end of the bin by a predetermined length. Further it is necessary to provide a reciprocal pusher member which pushes the stapled sheet stack back to the bin so that the stapled sheet stack does not interfere with the stapler in moving to a next sheet stack.

In order to push right the sheet stack so that the sheet stack is returned to the bin straight, it is preferred that the reciprocal pusher member be caused to act on the trailing edge of the sheet stack at the middle thereof. However since the sheets are various in size and at the same time the sheet stack on the bin is generally shifted toward one side of the bin so that a predetermined side edge of the sheet stack is in contact with a predetermined reference surface irrespective of the size of the sheets, it is impossible to cause a single fixed reciprocal pusher member to act on the trailing edge of the sheet stack at the middle thereof irrespective of the size of the sheets.

Conventionally, a plurality of reciprocal pusher members are arranged in the direction of width of the sheet at predetermined intervals in order to push right the sheet stack so that the sheet stack is returned to the bin straight.

SUMMARY OF THE INVENTION

In view of the foregoing observations and description, the primary object of the present invention is to provide a sheet sorter with a stapler in which the sheet stack is returned to the bin straight with a single reciprocal pusher member.

The sheet sorter with a stapler in accordance with the present invention comprises a plurality of bins arranged in a vertical direction each of which receives a plurality of sheets discharged from an image recording apparatus and forms thereon a stack of sheets, a sheet transfer means which transfers the sheets discharged from the image recording apparatus, an indexer which receives the sheets from the sheet transfer means and is movable up and down along the array of sheet inlet ends of the bins to distribute the sheets to the respective bins through the sheet inlet ends thereof, and a stapler which is movable up and down along the array of the sheet inlet ends of the bins and in a direction of width of the sheets to staple the stack of sheets on each bin which has been ejected beyond the sheet inlet end of the bin by a predetermined length, and is characterized by having a single reciprocal pusher member which is actuated after completion of stapling by the stapler and pushes the stapled stack of sheets back to the bin and a centering means which moves the reciprocal pusher member to a position substantially opposed to the middle of the trailing edge of the stack of sheets after stapling by the stapler.

It is preferred that the reciprocal pusher member is provided on the stapler to be moved along with the stapler.

Further it is preferred that a lineup means for lining up the edges of the sheets in the stack on each bin be provided.

In one embodiment, the lineup means comprises a side lineup member which pushes one side edges of the sheets to bring the other side edges of the sheets into abutment against a predetermined side edge reference surface so that said the other side edges are brought into alignment with each other on the reference surface and the side lineup member is slightly retracted away from said one side edges of the sheets before the reciprocal pusher member is actuated after completion of stapling by the stapler.

For example, each bin is provided in one side wall thereof with a sheet take-out door which is opened to take out the sheet stack on the bin and the side edge reference surface is defined by the inner surface of the sheet take-out door when the door is closed.

In another embodiment of the present invention, the lineup means comprises a pair of lineup members which are opposed to each other in the direction of width of the sheets and are movable toward and away from each other on opposite sides of the sheets in synchronization with each other, the lineup members are moved toward each other to push the respective side edges of the sheet to hold the longitudinal axis of the sheet in alignment with a predetermined reference line irrespective of the size of the sheet, and the lineup members are slightly retracted away from the side edges of the stack of sheets before the reciprocal pusher member is actuated after completion of stapling by the stapler.

In the sheet sorter in accordance with the present invention, the single reciprocal pusher member is centered relative to the trailing edge of the sheet stack when the reciprocal pusher member pushes the sheet stack back to the bin, the sheet stack can be returned straight to the bin irrespective of the size of the sheets without providing a plurality of reciprocal pusher members.

When the reciprocal pusher member is provided on the stapler, the reciprocal pusher member and the stapler can be moved by one drive mechanism.

Further positioning the side lineup member slightly retracted from the side edge of the stack of sheets remote from the side edge reference surface or positioning the pair of lineup members slightly retracted from the side edges of the stack of sheets contributes to returning the sheet stack straight to the bin without increasing the load on the reciprocal pusher member.

DESCRIPTION OF THE PREFERRED EMBODIMENT

Figure 1:
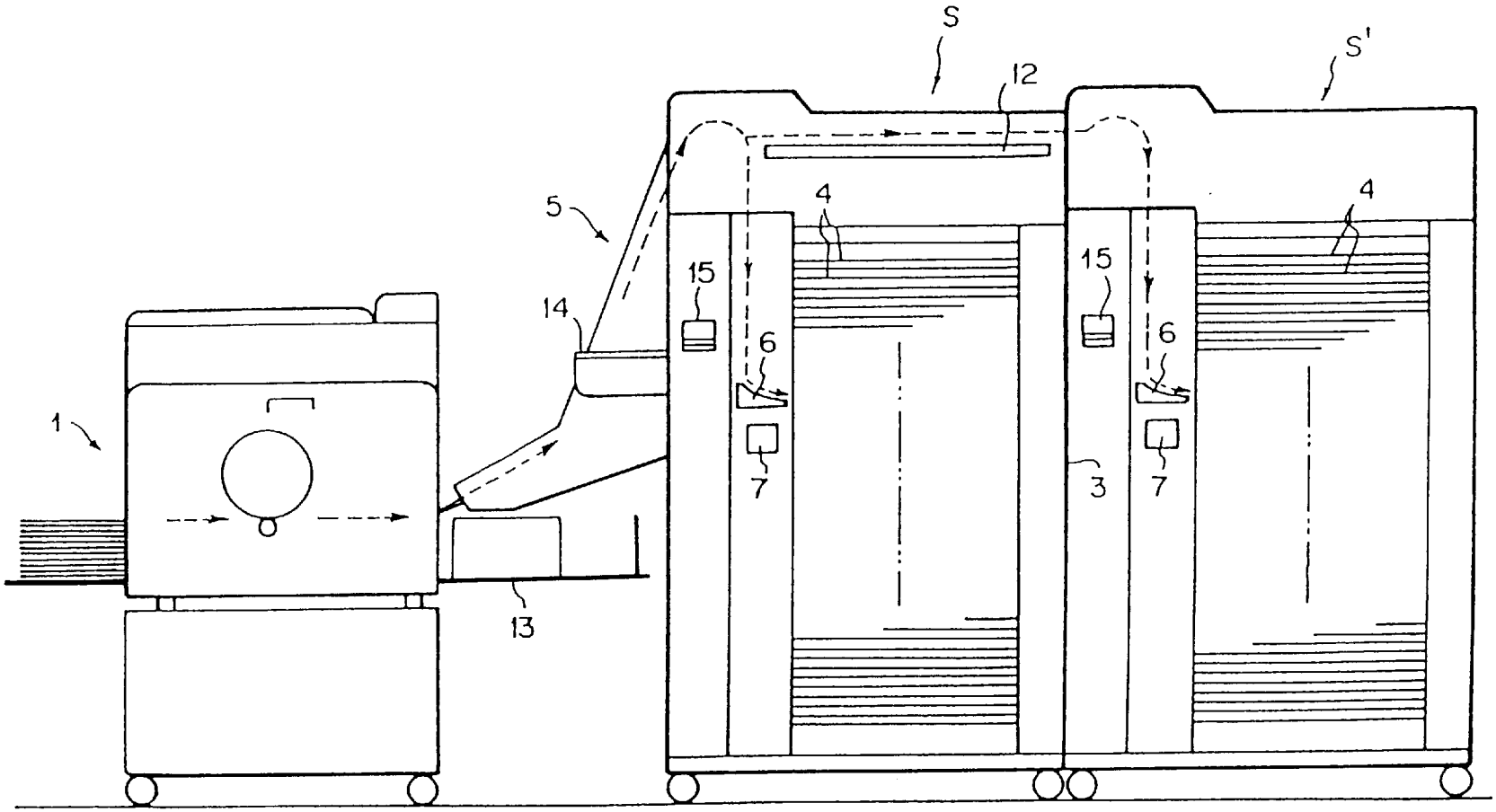
FIG. 1 is a schematic side view showing a sheet sorter with a stapler in accordance with a first embodiment of the present invention with the sorter connected to an image recording apparatus.
Figure 2:
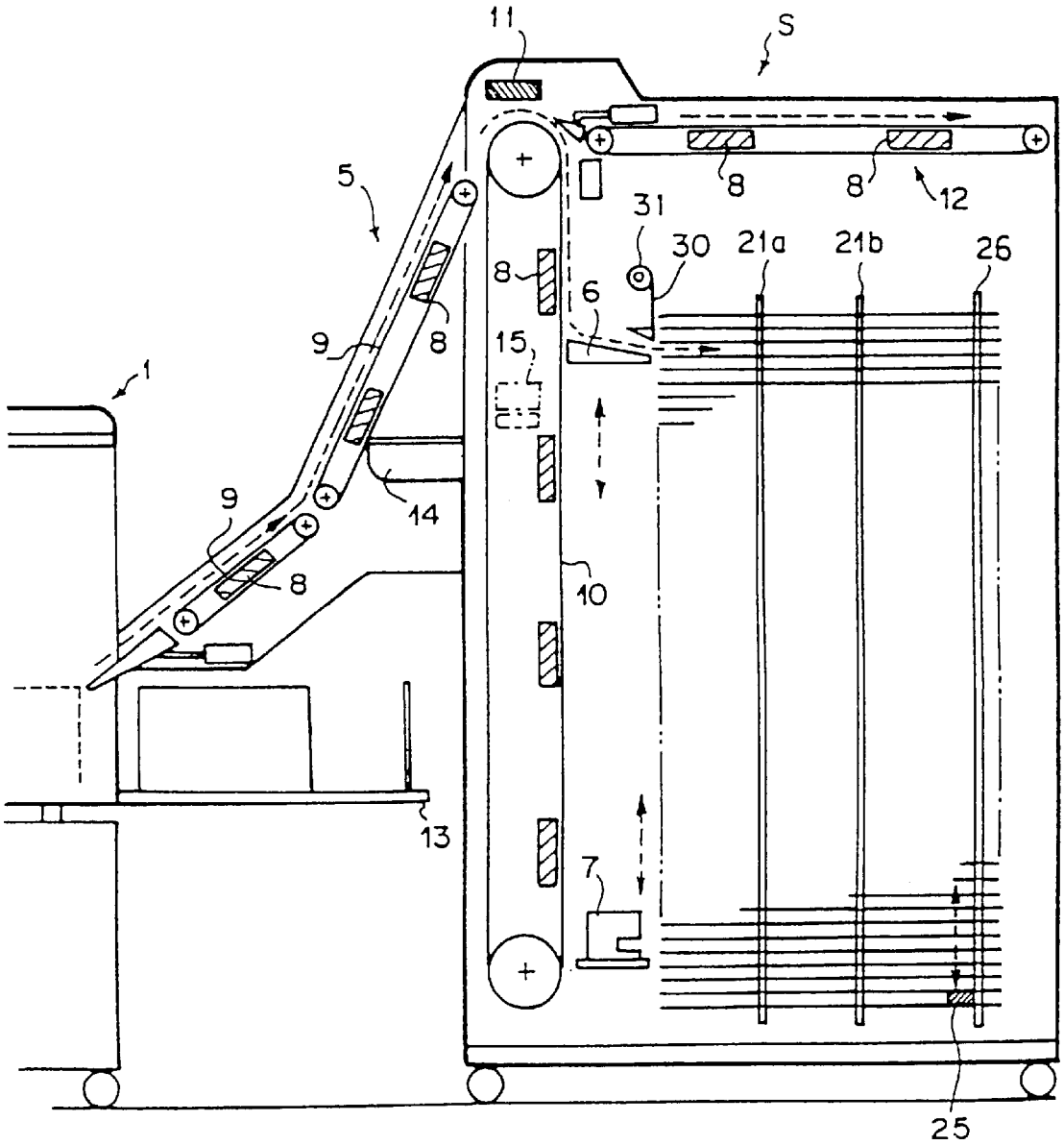
FIG. 2 is a side through-view showing the internal structure of the sorter shown in FIG. 1.

In FIGS. 1 to 4, a sheet sorter S comprises a plurality of (e.g., fifty) bins (sort trays) 4 which are disposed in fixed positions in a frame 3 at predetermined intervals in the vertical direction and receive a plurality of recorded sheets 2 (FIG. 3) discharged from an image recording apparatus 1 such as a printer to form a stack of the sheets 2 on each bin 4, a sheet transfer means 5 which transfers the sheets 2 discharged from the image recording apparatus 1 toward the bins 4, an indexer 6 which is movable up and down along the array of the sheet inlet ends 4*a* of the bins 4 and distributes the sheets 2 transferred by the sheet transfer means 5 to the respective bins 4, and a stapler 7 which is movable along the path of travel of the indexer 6 independently of the indexer 6.

In the case where the image recording apparatus 1 is a printer, especially a stencil printer, a number of sheets can be printed in a short time and recorded sheets 2 carrying thereon wet ink are discharged at a high rate. Accordingly no conveyor roller is used in the sheet transfer means 5 and the sheet transfer means 5 comprises a perforated conveyor belts 9 and 10 which convey the sheets 2 with the back side of the sheets 2 attracted against the belts 9 and 10 under vacuum applied by blowers 8 and a fan 11 which presses the sheets 2 against the belt 10 under an air pressure as clearly shown in FIG. 2.

In this particular embodiment, the sheet sorter S is arranged so that a plurality of slaves S' having the same structure as the main sheet sorter S can be connected to the sheet sorter S as shown in FIG. 1 in order to increase the total number of the bins 4. The slaves S' are connected to the main sheet sorter S on the side remote from the image recording apparatus 1. A sheet conveyor 12 is demountably mounted on an upper portion of the main sheet sorter S and the sheets 2 in the main sheet sorter S are transferred to the slaves S' by the sheet conveyor 12 when the slaves S' are connected to the main sheet sorter S.

The image recording apparatus 1 is provided with a sheet tray 13 on which the discharged sheets 2 are stacked when sorting of the sheets 2 is not necessary. Further a control panel 14 and an exterior electric stapler 15 are mounted on the outer surface of the sheet sorter S.

Figure 3:
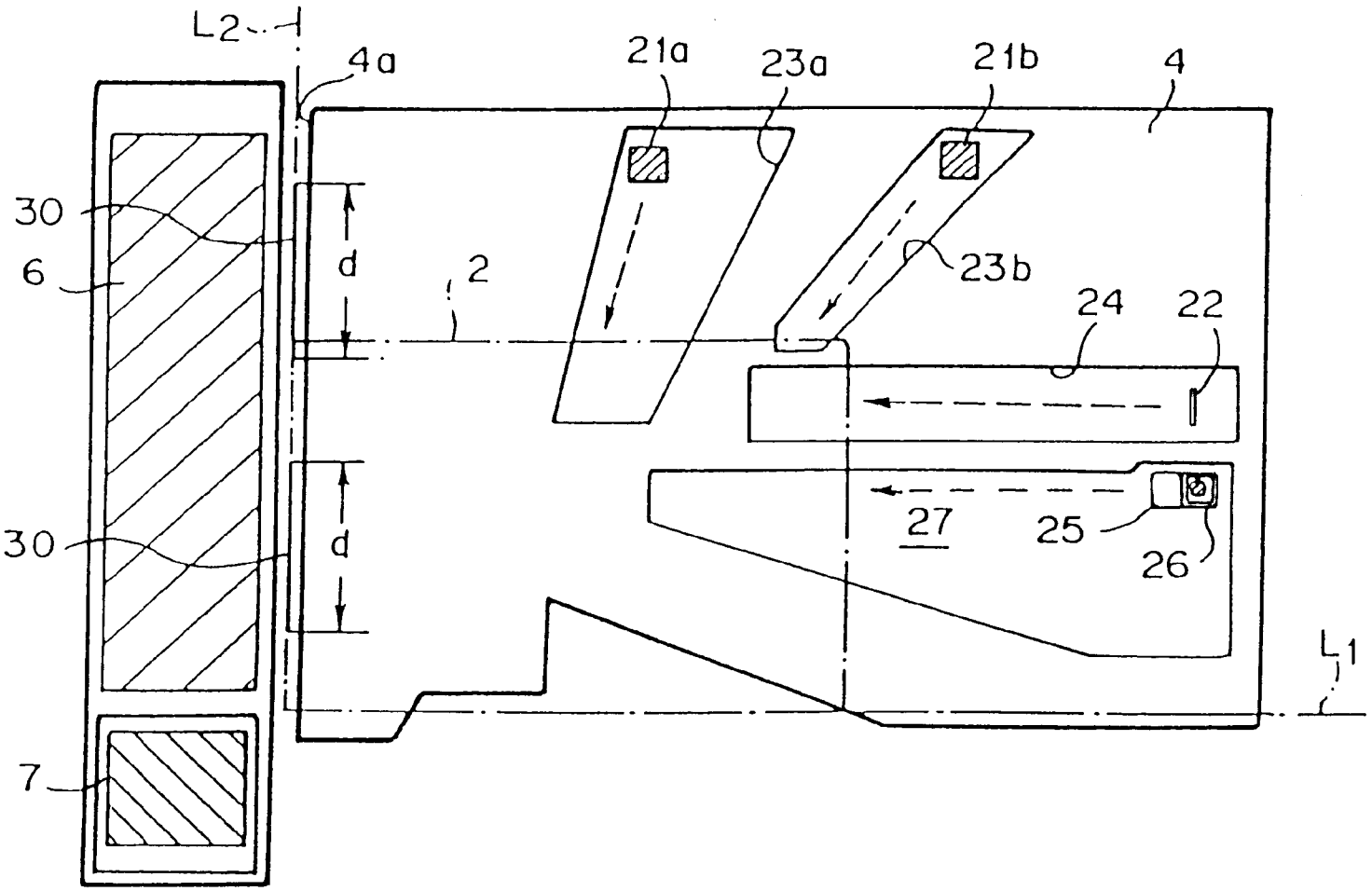
FIG. 3 is a schematic plan view showing the arrangement of the bins, indexer, stapler, sheet stack ejector and the like in the sorter shown in FIG. 1.

As shown in FIG. 3, the stapler 7 waits in a waiting position retracted the path of the indexer 6 in a direction of width of the sheets 2 (in a vertical direction as seen in FIG. 3) while the indexer 6 is moving up and down. The waiting position of the stapler 7 is such that the indexer 6 is brought into alignment with the stapler 7 or overlaps with the stapler 7 as seen in a side view of the sheet sorter S when the indexer 6 is moved to a position where it can distribute a sheet 2 to the lowermost bin 4.

Figure 4:
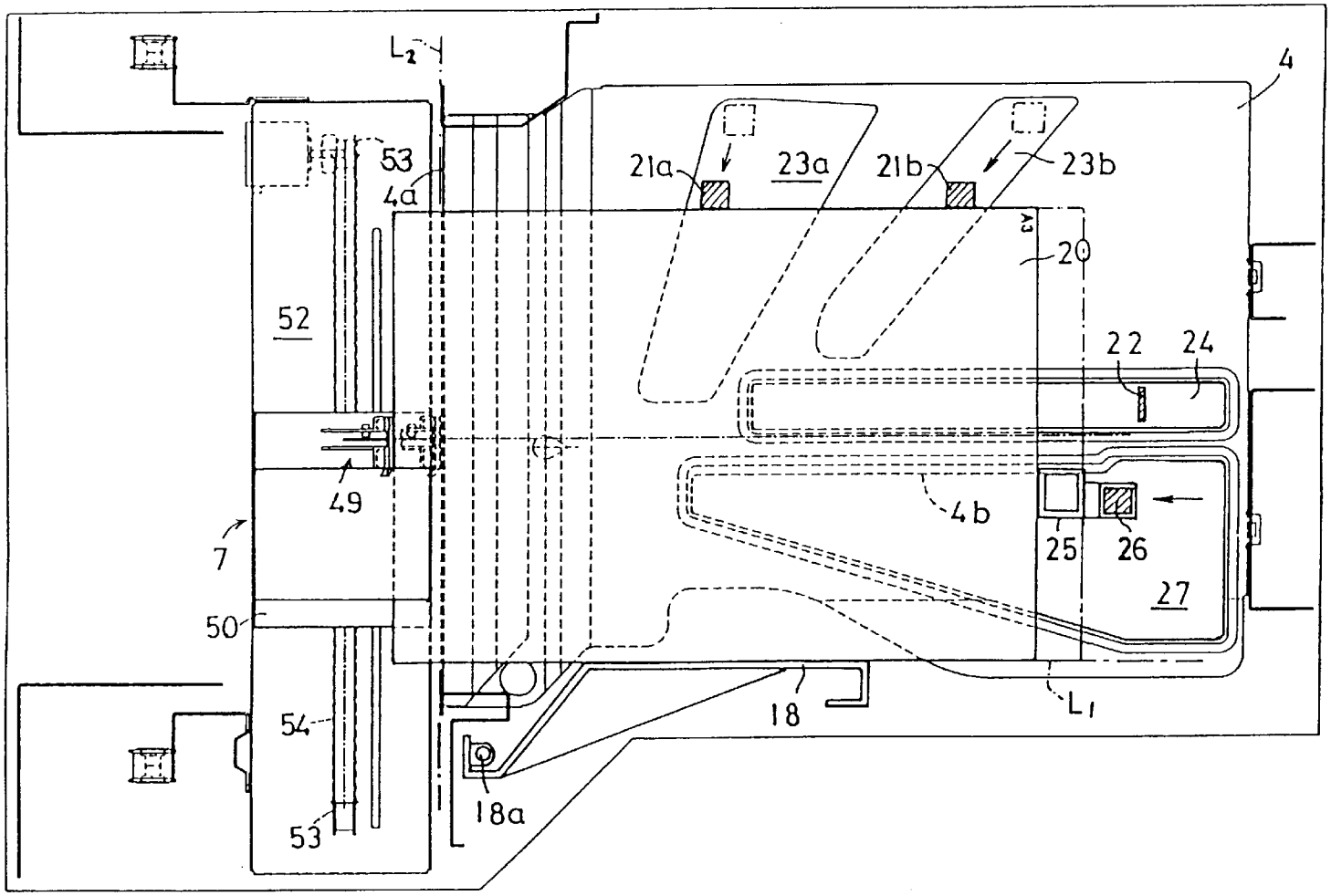
FIG. 4 is a plan view showing the state of the sheet sorter shown in FIG. 1 when the stapler is operating.

As shown in FIG. 4, side edges of the sheets 2 placed on each bin 4 are lined up along a side edge reference surface L1 defined by the inner surface of a sheet stack take-out door 18 which is rotatable about a pin 18*a*. For this purpose, there vertically extend through the plurality of bins 4 a pair of side lineup rods 21*a* and 21*b* which push the sheet 2 in the direction of width of the sheet 2 and bring the side edge of the sheet 2 into abutment against the side edge reference surface L1, a stopper member 22 of a resilient material such as rubber band which the leading edge of the sheet 2, which is released into the bin 4 at a high speed from the indexer 6, is brought into abutment against, thereby gently stopping the sheet 2, and a guide rail 26 along which a sheet stack ejector 25 (to be described later) is moved up and down.

The side lineup rods 21*a* and 21*b* and the stopper member 22 are moved respectively along slots 23*a*, 23*b* and 24. The stopper member 22 is moved along the slot 24 left and right as seen in FIG. 4 according to the size of the sheets 2 to be released from the indexer 6.

The guide rail 26 doubles as a lineup rod which pushes the leading edge of the sheet 2 to move the sheet 2 toward the sheet inlet end 4*a* of the bin 4 so that the trailing edge of the sheet 2 is brought into abutment against a trailing edge reference surface L2. For this purpose, the guide rail 26 is provided with a flat vertical surface 26*a* facing toward the sheet inlet end 4*a* of the bin 4. The guide rail 26 is moved left and right as seen in FIG. 4 by a drive mechanism (not shown) in an opening 27 formed in the bin 4.

As shown in FIG. 4, the side lineup rods 21*a* and 21*b* are moved by a drive mechanism (not shown) at angles to the direction in which the sheet 2 is fed into the bin 4 so that they are simultaneously moved toward and away from both the reference surfaces L1 and L2 and can act on various sizes of the sheets 2 in optimum positions according to the size of the sheets 2 to be handled. Further the angle at which the path of the side lineup rod 21*b*, which is at a larger distance from the trailing edge reference surface L2, is inclined to the feeding direction of the sheet 2 is smaller than that of the other side lineup rod 21*a*, and accordingly as the rods 21*a* and 21*b* are moved toward the side edge of the sheet 2, the distance between the rods 21*a* and 21*b* becomes smaller.

After completion of distribution of the sheets 2 to all the bins 4 by the indexer 6, the sheet stacks 20 (FIG. 4) on the respective bins 4 are ejected toward the stapler 7 beyond the trailing edge reference surface L2 by a predetermined length in sequence for stapling operation. For this purpose, a sheet stack ejector 25 is provided. The sheet stack ejector 25 can be moved by a drive mechanism (not shown) up and down in the openings 7 of the respective bins 4 along the guide rail 26 when the guide rail 26 is in the rightmost position shown in FIG. 3.

When the sheet stack 20 on one of the bins 4 is to be stapled, the sheet stack 20 on the bin 4 must be ejected from the sheet inlet end 4*a* of the bin 4 by a predetermined length, and accordingly the sheet stack ejector 25 is provided with an ejecting surface positioned at a distance not smaller than the predetermined length from the vertical surface of the guide rail 26. When the guide rail 26 brings the trailing edges of the sheets 2 into alignment with each other on the trailing edge reference surface L2, the sheet stack ejector 25 is moved upward or downward along the guide rail 26 to a position where the sheet stack ejector 25 does not interfere with the lineup operation of the guide rod 26.

When stapling the sheet stack 20 on a selected bin 4, the sheet stack ejector 25 is first moved along the guide rail 26 to a predetermined position suitable for ejecting the sheet stack 20 on the selected bin 4 and the guide rail 26 is moved toward the sheet inlet end 4*a* of the selected bin 4 from the position shown in FIG. 4. As the guide rail 26 is moved toward the sheet inlet end 4*a,* the sheet stack ejector 25 comes to be engaged with both the upper surface of a linear edge portion 4*b* (FIG. 4) of the opening 27 of the selected bin 4 and the lower surface of the linear edge portion 4*b* of the bin 4 just above the selected bin 4. Thus the sheet stack ejector 25 ejects the sheet stack 20 on the selected bin 4 toward the stapler 7 while moving toward the stapler 7 under the guidance of the surfaces of the engagement portions 4*b* of the adjacent bins 4 held therebetween.

Figure 5:
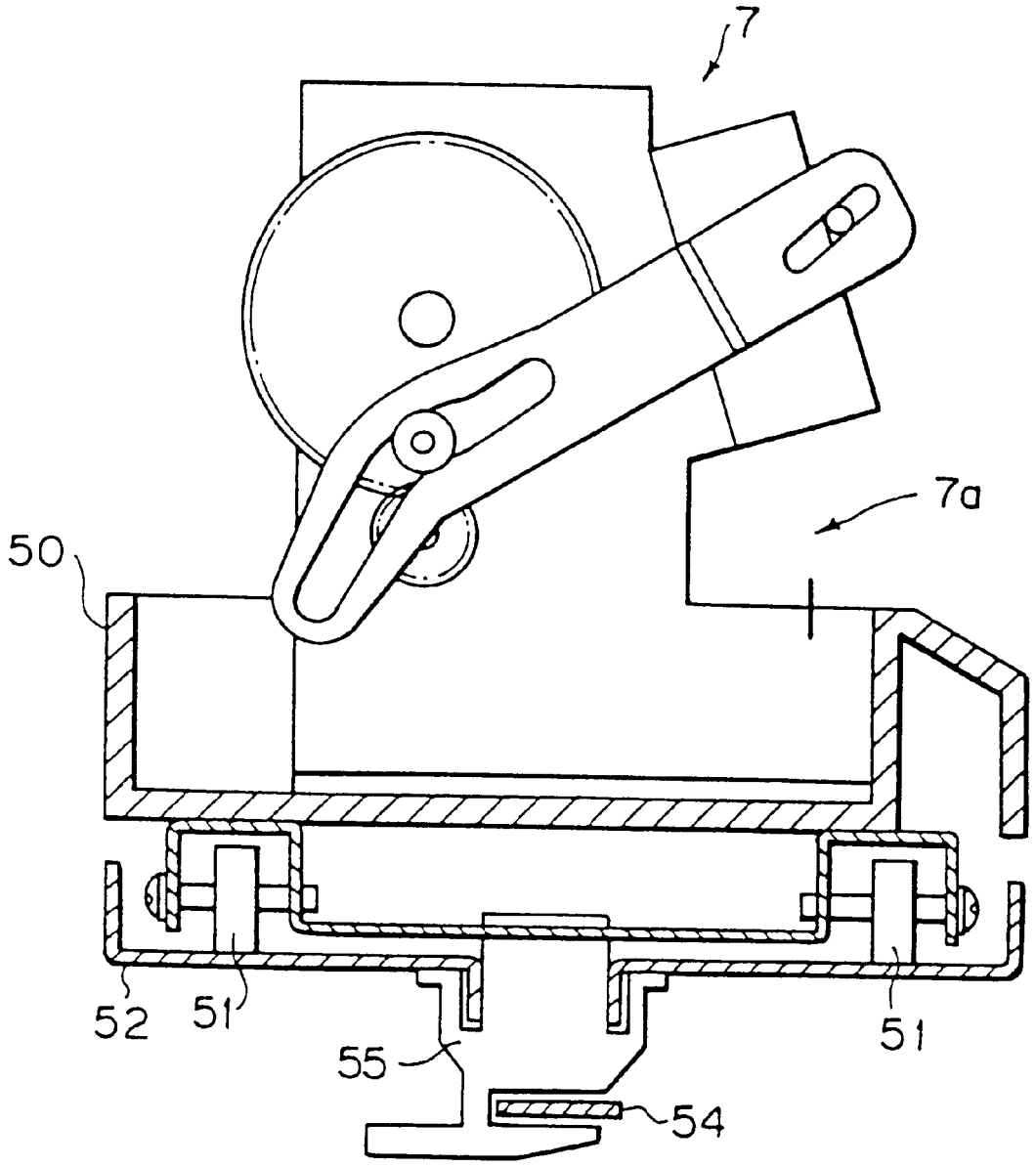
FIG. 5 is a side view partly in cross-section of the stapler.
Figure 6:
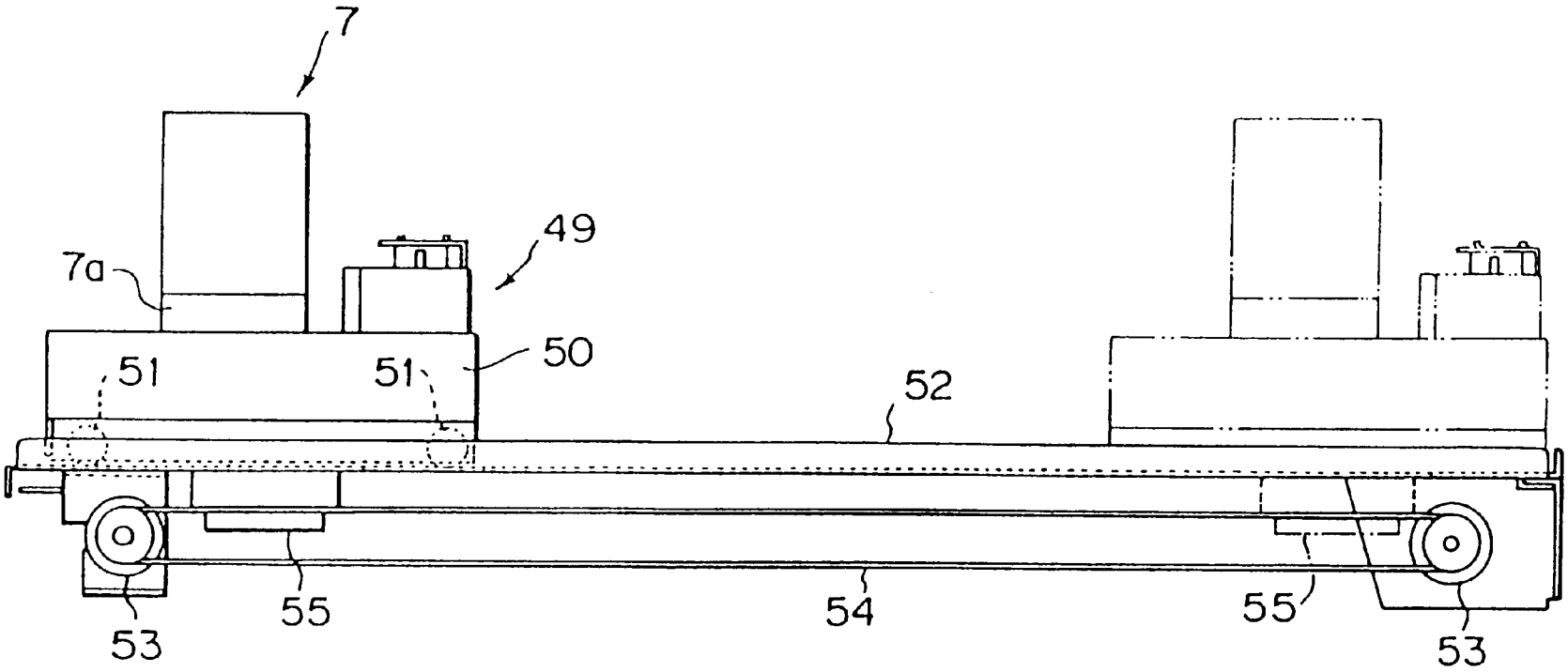
FIG. 6 is a front view of the stapler unit as seen from the indexer side.

Referring also to FIGS. 5 and 6, a stapler unit including the stapler 7 will be described in detail, hereinbelow.

The stapler 7 is provided with a throat 7*a* into which the sheet stack 20 is inserted when stapling the sheet stack 20. As shown in FIGS. 5 and 6, the stapler unit comprises an elongated lift 52 which extends in the direction of width of the sheet 2 (left and right as seen in FIG. 6) and is moved up and down along the path of travel of the indexer 6 by a drive means (not shown) and a base table 50 which is provided with four wheels 51 at four corners of the bottom surface thereof and is placed on the lift 52 to be movable in the direction of width of the sheet 2 on the lift 52. The stapler 7 and a reciprocal sheet pusher mechanism 49 for returning the stapled sheet stack 20 into the bin 4 are provided on the base table 50 integrally therewith. A pair of pulleys 53 are provided on opposite end portions of the lift 52 and an endless belt 54 is passes around the pulleys 53. A member 55 fixed to the base table 50 is connected to the endless belt 54. Thus the stapler 7 and the reciprocal sheet pusher mechanism 49 are moved in the direction of width of the sheet 2 on the lift 52 driven by the endless belt 54, which is driven by an electric motor (not shown).

The stapler unit is in the waiting position, which is the lowermost position thereof, with the stapler 7 held in a position retracted from the path of travel of the indexer 6 in the direction of width of the sheet 2 when the indexer 6 is operating. When the stapler 7 operates, the indexer 6 is positioned in a retracted position above the uppermost bin 4.

Figure 7A:
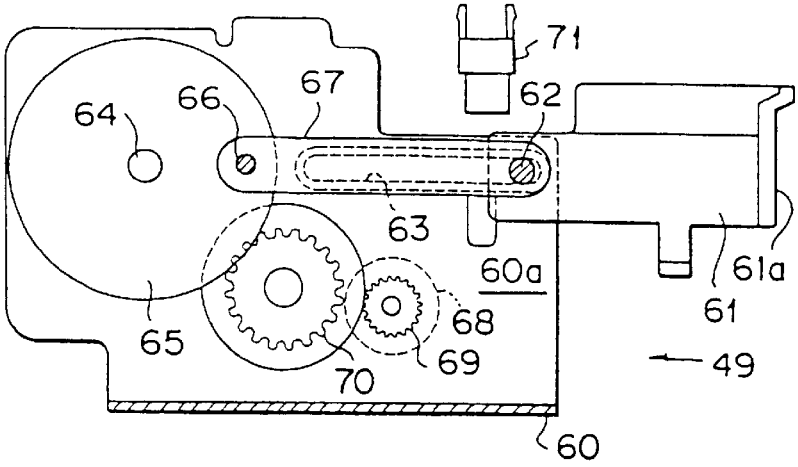
FIGS. 7A to 7C are side views for illustrating the operation of the reciprocal sheet pusher mechanism.
Figure 7B:
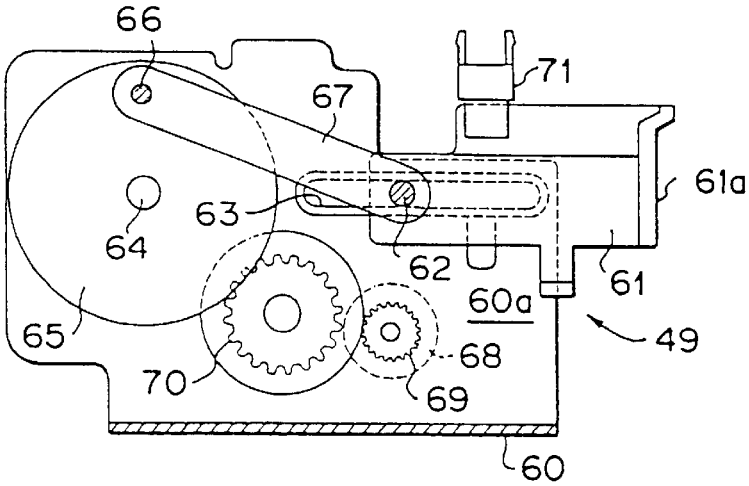
Figure 7C:
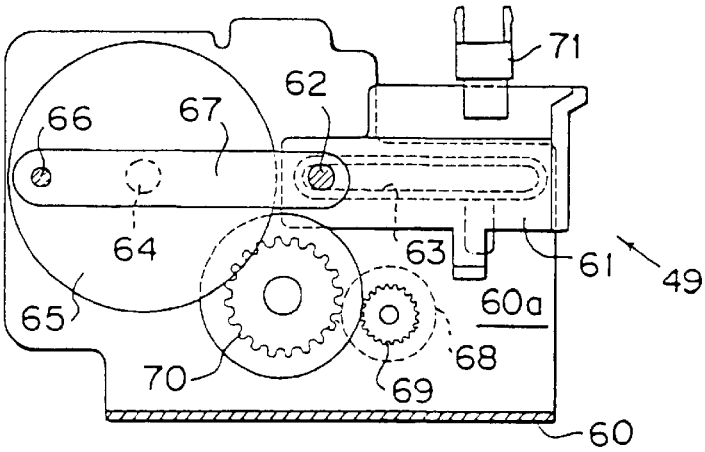

As shown in FIGS. 7A to 7C, the reciprocal sheet pusher mechanism 49 comprises a base bracket 60 fixed to the base table 50 of the stapler unit and a reciprocal pusher member 61 mounted on the base bracket 60. The base bracket 60 has a pair of walls 60*a* which are perpendicular to the direction of travel of the base table 50 on the lift 52 and spaced from each other in the direction of travel of the base table 50. The reciprocal pusher member 61 is provided with a vertical surface 61*a* adapted to be brought into abutment against the sheet stack 20 and is mounted to be movable between the walls 60*a*.

That is, each of the walls 60*a* is provided with a guide groove 63 extending left and right in FIGS. 7A to 7C and pins 62 projecting from the respective side surfaces of the pusher member 61 in perpendicular to the walls 60*a* are loosely fitted in the guide grooves 63. Thus the pusher member 61 is mounted on the base bracket 60 to be linearly movable between the forward position shown in FIG. 7A and the retracted position shown in FIG. 7C. A shaft 64 is supported for rotation on the walls 60*a* and a larger diameter gear 65 is fixed to the shaft 64. A pin 66 is fixed to the gear 65 near the outer peripheral surface thereof and is connected to one of the pins 62 on the pusher member 61 by way of a link member 67. The larger diameter gear 65 is in mesh with an idler gear 70 which is in mesh with a gear 69 on the output shaft of an electric motor 68. Accordingly when the larger diameter gear 65 is rotated by the motor 68, the reciprocal pusher member 61 is moved back and forth as shown in FIGS. 7A to 7C. A sensor 71 which detects that the reciprocal pusher member 61 is in the retracted position is disposed on the base bracket 60.

Figure 8:
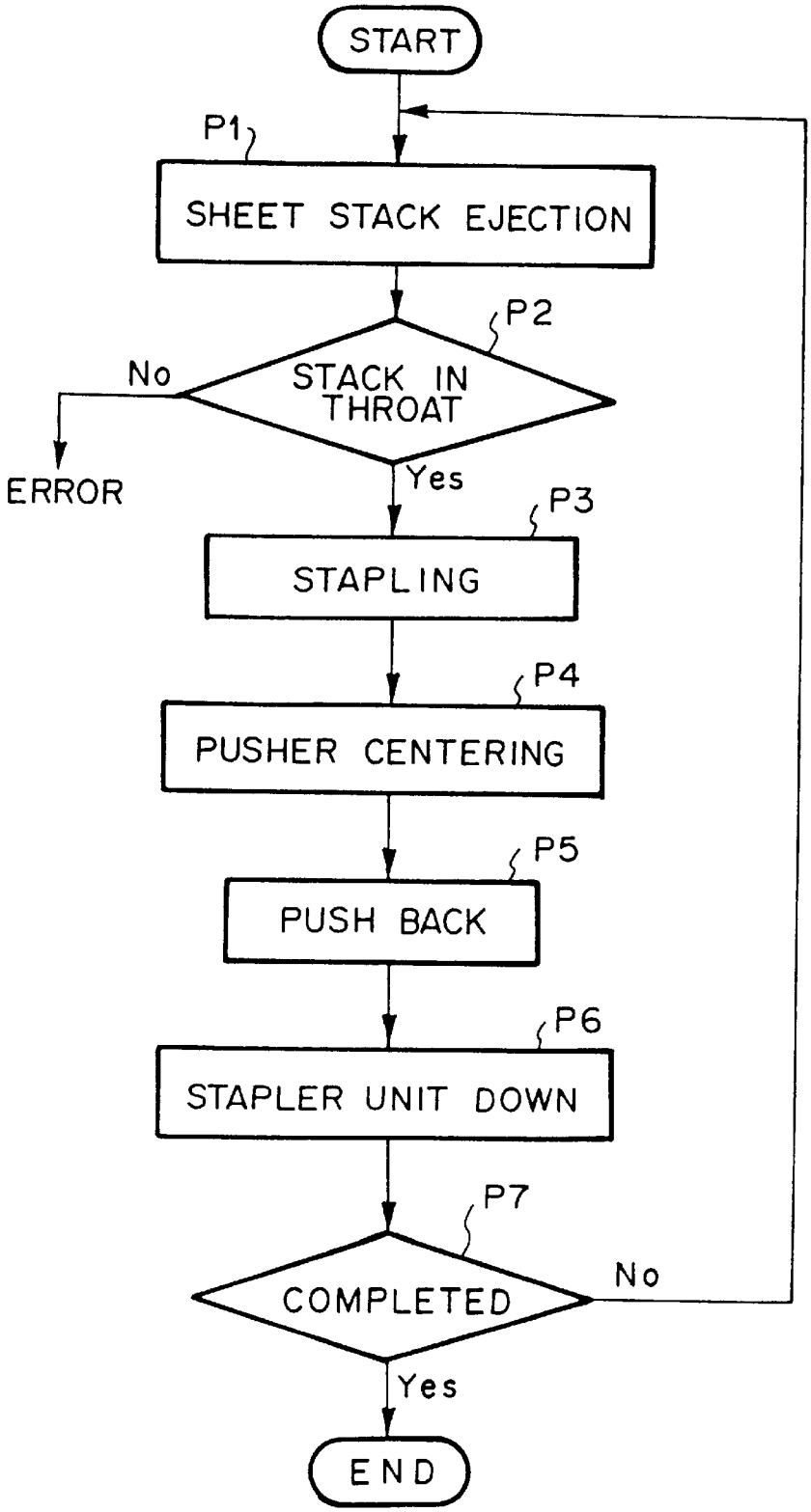
FIG. 8 is a flow chart for illustrating control of the sheet sorter during the stapling operation.

The operation of the stapler unit will be described with reference to FIGS. 8 and 9, hereinbelow. In FIG. 9, the side lineup rods 21*a* and 21*b* which bring the side edges of the sheets 2 in alignment with each other on the side edge reference surface L1 are represented by a single lineup member 21.

Figure 9A:
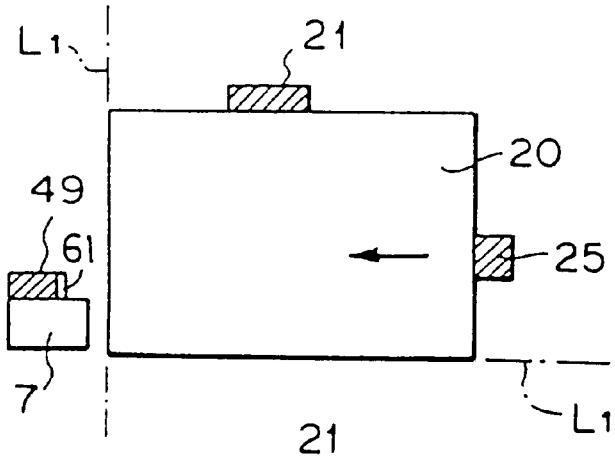
FIGS. 9A to 9D are views for illustrating the procedure of stapling.
Figure 9B:
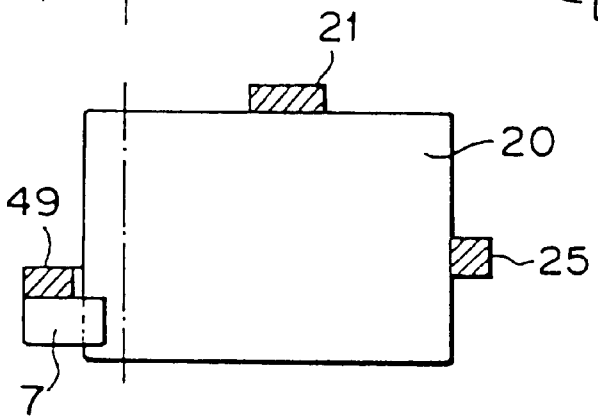

With the side edges of the sheets 2 in the sheet stack 20 in alignment with each other on the side edge reference surface L1 and the throat 7*a* of the stapler 7 opposed to a predetermined portion of the sheet stack 20 at which the sheet stack 20 is to be stapled as shown in FIG. 9A, the sheet stack 20 is ejected toward the stapler 7 so that the trailing edge portion of the sheet stack 20 is inserted into the throat 7*a* of the stapler 7 as shown in FIG. 9B. (step P1 in the flow chart shown in FIG. 8) At this time, the reciprocal pusher member 61 of the reciprocal sheet pusher mechanism 49 is in the retracted position shown in FIG. 7C. A sensor on the stapler 7 detects whether the sheet stack 20 is in the throat 7*a* of the stapler 7, and when the sensor detects that the sheet stack 20 is in the throat 7*a* of the stapler 7 (YES in step P2), the stapler 7 is actuated to staple the sheet stack 20 (step P3). Otherwise (NO in step P2), it is judged that error occurs.

Figure 9C:
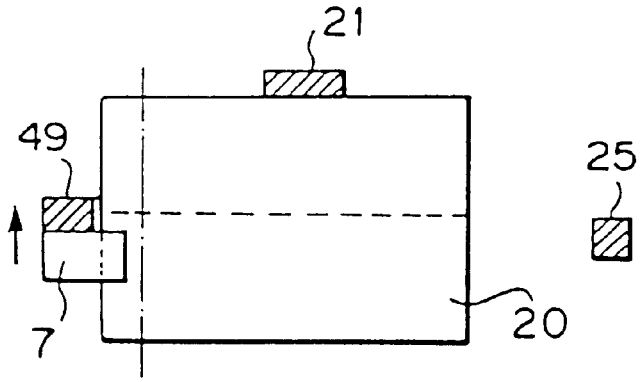
Figure 9D:
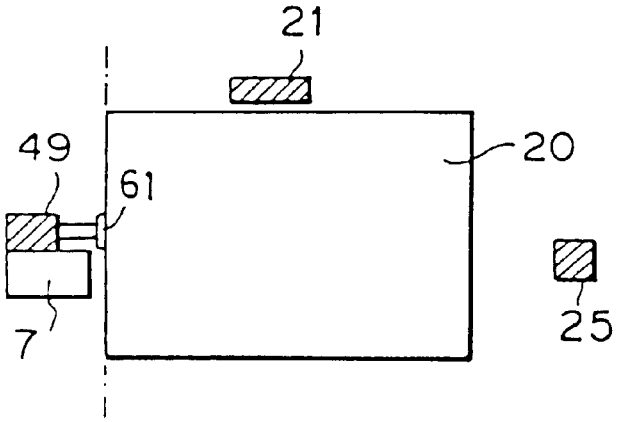

After completion of stapling, the base table 50 of the staple unit is moved on the lift 52 according to sheet size information input from the image recording apparatus 1 so that the reciprocal pusher member 61 of the reciprocal sheet pusher mechanism 49 is centered with respect to the stapled sheet stack 20 as shown in FIG. 9C (step P4). Then the side lineup member 21 is moved to a position slightly retracted from the side edge of the sheet stack 20 remote from the side edge reference surface L1 as shown in FIG. 9D. In this state, the reciprocal pusher member 61 is moved from the position shown in FIG. 7C to the position shown in FIG. 7A, whereby the sheet stack 20 is pushed back to the bin 4 as shown in FIG. 9D. (step P5)

By centering the reciprocal pusher member 61 with respect to the trailing edge of the sheet stack 20 according to the size of the sheets 2 and positioning the side lineup member 21 slightly retracted from the side edge of the sheet stack 20 remote from the side edge reference surface L1, the sheet stack 20 can be pushed back straight without increasing the load on the reciprocal pusher member 61.

Thereafter, the reciprocal pusher member 61 is returned to the position shown in FIG. 7C and the staple unit is moved downward to the bin 4 just below(step P6). Then the steps P1 to P6 are repeated until the sheet stacks 20 are all stapled. (step P7)

Figure 10:
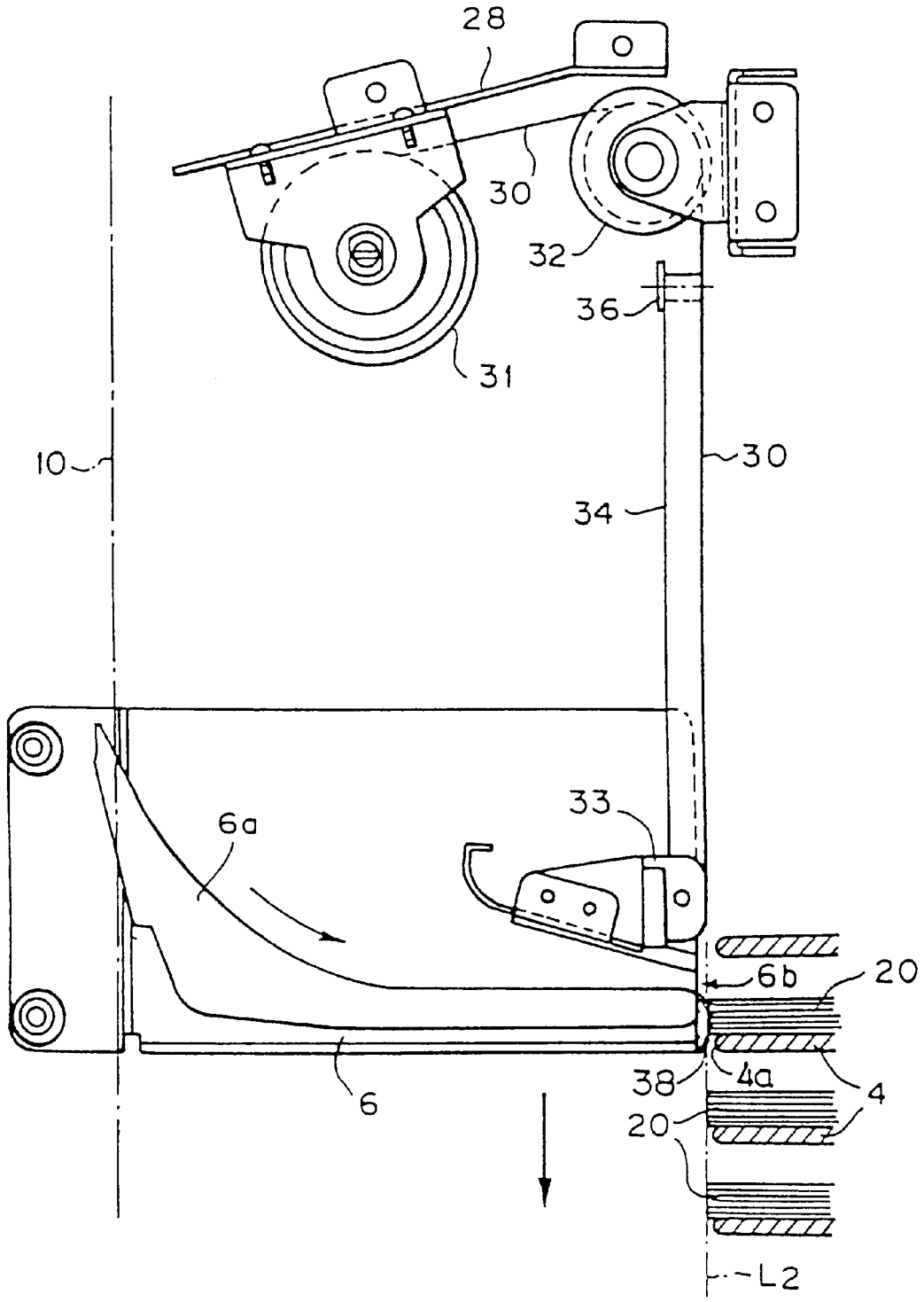
FIG. 10 is a side view showing the member for defining the trailing edge reference surface.
Figure 11:
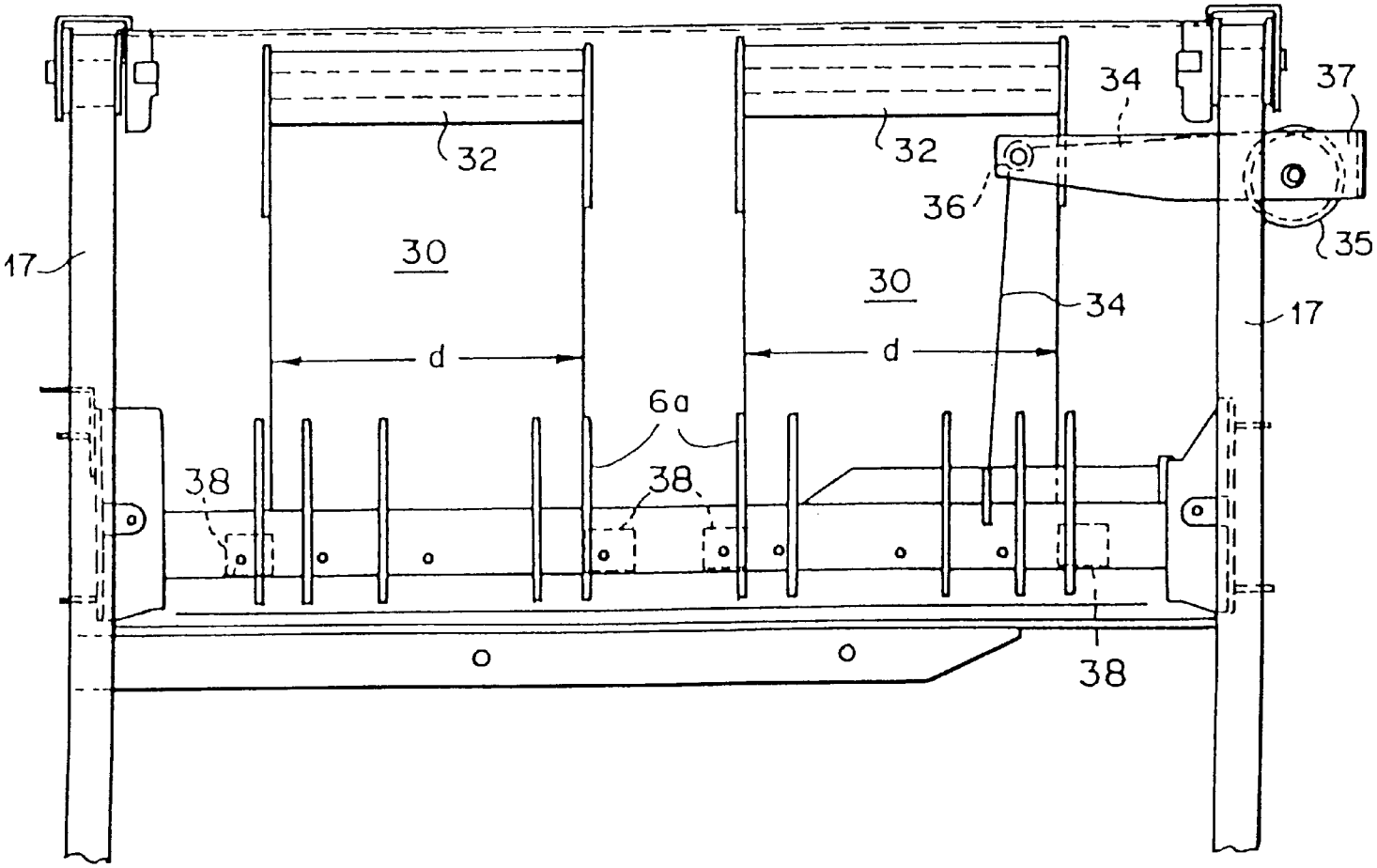
FIG. 11 is a front view showing the same as seen from the indexer side.

FIGS. 10 and 11 show a member for defining the trailing edge reference surface L2. As shown in FIGS. 3 and 11, the trailing edge reference surface L2 extends along the array of the sheet inlet ends 4*a* of the bins 4 and is defined by a pair of strip-like spring members 30 each having a width d. The spring member 30 is in a continuous length and fed out from a roll in a casing 31 (FIG. 10) which is fixed to the frame 3 by way of a bracket 28 above the uppermost position of the indexer 6. The part of the spring member 30 extending outside the casing 31 is passed around a reel 32 and extends right downward. The leading end of the spring member 30 is fixed to a fixing member 33 which is provided just above the sheet discharge port 6*b* of the indexer 6 close thereto.

Accordingly the spring members 30 are long fed out from the casing 31 as the indexer 6 moves downward and close the sheet inlet ends 4*a* of the bins 4 which are above the sheet discharge end 6*b* of the indexer 6, thereby forming the trailing edge reference surface L2. As the indexer 6 moves upward the spring members 30 are taken up into the casing 31.

In this particular embodiment, a second strip-like spring member 34 which is smaller than the spring member 30 in width is employed to reinforce the spring member 30, thereby holding flat the spring member 30. That is, the second spring member 34 is in a continuous length and fed out from a roll in a casing 35 which is fixed to the frame 3 by way of a bracket 37 so that the longitudinal axis of the casing 35 is substantially perpendicular to that of the casing 31 of the spring member 30. The part of the second spring member 34 extending outside the casing 35 is passed around a reel 36 and extends downward with its one side edge in contact with the indexer side surface of the spring member 30 substantially perpendicularly thereto. The leading end of the second spring member 34 is fixed to the indexer 6 at a portion above the sheet discharge port 6*b* of the indexer 6.

Also the second spring member 34 is fed out from the casing 35 as the indexer 6 moves downward and taken up into the casing as the indexer 6 moves upward. For instance, the second spring member 34 may be of a constant load spring such as "Conston®".

Further in this particular embodiment, as a means for assisting the spring members 32 in lining up the trailing edges of the sheets 2 in the sheet stack 20, hollow resilient members 38 are mounted on the indexer 6 below the sheet discharge port 6*b* on opposite sides of each spring member 20. The hollow resilient members 38 is formed of, for instance, "Mylar®". Each resilient member 38 arcuately bulges toward the bin 4 and has an inclined surface which presses the trailing edge of the sheet stack 20 toward the guide rail 26.

The operation of the sheet sorter S with the arrangement described above will be described, hereinbelow.

(1) First the indexer 6 is located in a position where the sheet discharge port 6*b* thereof is opposed to the sheet inlet end 4*a* of the uppermost bin 4 and the lift 52 of the stapler unit is located in its lowermost position with the stapler 7 held in the waiting position laterally retracted from the path of the indexer 6 as shown by the solid line in FIG. 6. At this time, the reciprocal pusher member 61 is in the retracted position shown in FIG. 7C, the side lineup rods 21*a* and 21*b* are held in the respective retracted positions at a maximum distance from the side edge reference surface L1 and the stopper 22 is held in a position corresponding to the size of the sheets 2 to be discharged from the image recording apparatus 1. Further the guide rail 26 is held in the position shown in FIG. 3 with the sheet stack ejector 25 held in the opening 27 of the lowermost bin 4.

(2) Assuming that the image recording apparatus 1 prints forty documents each of twenty pages, the image recording apparatus 1 first discharges forty sheets 2 of page 20. Accordingly, while moving downward, the indexer 6 distributes one sheet 2 of page 20 to each bin 4 up to the fortieth bin 4 as numbered from above. The sheet 2 released into each bin 4 slides on the bin 4 and is stopped by the stopper member 22.

(3) At the time distribution of the sheets 2 of page 20 to the forty bins 4 is completed, the sheet inlet end 4*a* of the fortieth bin 4 is kept open though the sheet inlet ends 4*a* of the first (uppermost) to thirty-ninth bins 4 have been closed by the spring members 30. Accordingly, the indexer 6 is further moved downward by a small distance, thereby closing the sheet inlet end 4*a* of the fortieth bin 4 by the spring members 30.

(4) Thereafter the side lineup rods 21*a* and 21*b* are moved toward both the reference surfaces L1 and L2, thereby bringing the side edge of the sheet 2 in each bin 4 into alignment with the reference surface L1 while the guide rail 26 is moved toward the sheet inlet ends 4*a* of the bins 4, thereby bringing the trailing edge of the sheet 2 in each bin 4 into abutment against the spring members 30 or into alignment with the reference surface L2.

(5) Then the indexer 6 is returned upward to the position where the sheet discharge port 6*b* thereof is opposed to the sheet inlet end 4*a* of the uppermost bin 4 and distributes one sheet 2 of page 19 to each bin 4 up to the fortieth bin 4 to be superposed on the sheet 2 of page 20 in the similar manner. In this manner, a sheet stack 20 of sheets 2 of pages 1 to 20 is formed on each of the first to fortieth bins 4.

(6) Each time the indexer 6 is moved upward, the inclined surfaces of the hollow resilient members 38 are brought into contact with the trailing edges of the sheet stacks 20 on the respective bins 4 in sequence, thereby lining up the trailing edges of the sheets 2 in each stack 20.

(7) When formation of a sheet stack 20 of sheets 2 of pages 1 to 20 on each of the first to fortieth bins 4 is thus completed, the guide rail 26 is returned to the position shown in FIG. 4. Further the indexer 6 is moved upward beyond the position shown in FIG. 10 so that the sheet inlet ends 4*a* of all the bins 4 are opened.

(8) Following the upward movement of the indexer 6, the stapler unit is moved upward and the stapler 7 is moved on the lift 52 to a position where the throat 7*a* of the stapler 7 is opposed to a predetermined portion of the sheet stack 20 in the uppermost bin 4 at which the sheet stack 20 is to be stapled, and at the same time, the sheet stack ejector 25 is moved upward into the opening 27 of the uppermost bin 4. Thereafter the guide rail 26 is moved toward the sheet inlet end 4*a* of the bin 4 so that the sheet stack ejector 25 ejects the sheet stack 20 on the uppermost bin 4 beyond the reference surface L2 by a predetermined length, whereby the trailing edge of the sheet stack 20 is inserted into the throat 7*a* of the stapler 7 as shown in FIG. 9B. That the trailing edge of the sheet stack 20 is in the throat of the stapler 7 is detected by a detector (not shown) and the stapler 7 automatically staples the sheet stack 20.

(9) Thereafter the guide rail 26 is returned to the original position together with the sheet stack ejector 25 and the side lineup rods 21*a* and 21*b* are slightly moved away from the side edge of the sheet stack 20 as shown in FIG. 9C. At the same time, the base table 50 of the stapler 7 is moved on the lift 52 to center the reciprocal pusher member 61 of the reciprocal sheet pusher mechanism 49 with respect to the trailing edge of the stapled sheet stack 20. Then the reciprocal pusher member 61 is moved forward to push back the stapled sheet stack 20 into the bin 4 as shown in FIG. 9D.

Thereafter the reciprocal pusher member 61 is returned to the position shown in FIG. 7C.

(10) Then the stapler unit is moved downward to a position where the throat 7*a* of the stapler 7 is opposed to the sheet stack 20 in the second bin 4, and at the same time, the sheet stack ejector 25 is brought into the opening 27 of the second bin 4. Thereafter the guide rail 26 is moved toward the sheet inlet end 4*a* of the bin 4 so that the sheet stack ejector 25 ejects the sheet stack 20 on the second bin 4 beyond the reference surface L2 by the predetermined length, whereby the trailing edge of the sheet stack 20 is inserted into the throat 7*a* of the stapler 7. Then the stapler 7 automatically staples the sheet stack 20 and the guide rail 26 is returned to the original position together with the sheet stack ejector 25. At the same time, the base table 50 of the stapler 7 is moved on the lift 52 to center the reciprocal pusher member 61 of the reciprocal sheet pusher mechanism 49 with respect to the trailing edge of the stapled sheet stack 20. Then the reciprocal pusher member 61 is moved forward to push back the stapled sheet stack 20 into the bin 4 and the reciprocal pusher member 61 is returned to the position shown in FIG. 7C.

(11) In this manner, the sheet stacks 20 on all the bins 4 are stapled and after completion of the stapling operation, the stapler unit is returned to the waiting position. Then the sheet stack take-out door 18 is opened and the stapled sheet stacks are taken out.

As can be understood from the description above, in the sheet sorter S of this embodiment, since the single reciprocal pusher member 61 is centered relative to the trailing edge of the sheet stack 20 when the reciprocal pusher member 61 pushes the sheet stack 20 back to the bin 4, the sheet stack 20 can be returned stright to the bin 4 irrespective of the size of the sheets 2 without providing a plurality of reciprocal pusher members 61.

Further since the reciprocal pusher member 61 is provided on the stapler 7, the reciprocal pusher member 61 and the stapler 7 can be moved by one drive mechanism.

Further positioning the side lineup rods 21*a* and 21*b* slightly retracted from the side edge of the sheet stack 20 remote from the side edge reference surface L1 contributes to returning the sheet stack 20 straight to the bin 4 without increasing the load on the reciprocal pusher member 61.

Further by virtue of the spring members 30 which are fed out and taken up in response to up-and-down movement of the indexer 6 and defines the trailing edge reference surface L2, the trailing edges of the sheets 2 can be precisely aligned with each other on the reference surface L2 without providing each bin 4 with an erected surface defining the trailing edge reference surface as in conventional systems.

Further since the spring members 30 defining the trailing edge reference surface L2 are taken up into the casing 31 as the indexer 6 moves upward, all the bins 4 are free from any member which closes the sheet inlet ends 4*a* so long as the indexer 6 is in its uppermost position and accordingly ejecting the sheet stacks 20 beyond the sheet inlet ends 4*a* by the sheet stack ejector 25 and returning the same into the bins 4 by the reciprocal sheet pusher mechanism 49 are greatly facilitated.

Further since the side lineup rods 21*a* and 21*b* which push the sheets 2 in the direction of width to bring the side edges of the sheets 2 into abutment against the side edge reference surface L1, thereby lining up the side edges of the sheets 2 are movable so that they are simultaneously moved toward and away from both the reference surfaces L1 and L2, the lineup rods 21*a* and 21*b* can act on the sheets 2 in optimum positions according to the size of the sheets 2 to be handled. Further since the distance between the rods 21*a* and 21*b* becomes smaller as the rods 21*a* and 21*b* are moved toward the side edge of the sheet 2, the positions in which the rods 21*a* and 21*b* act on the sheets 2 can be further better.

Figure 12:
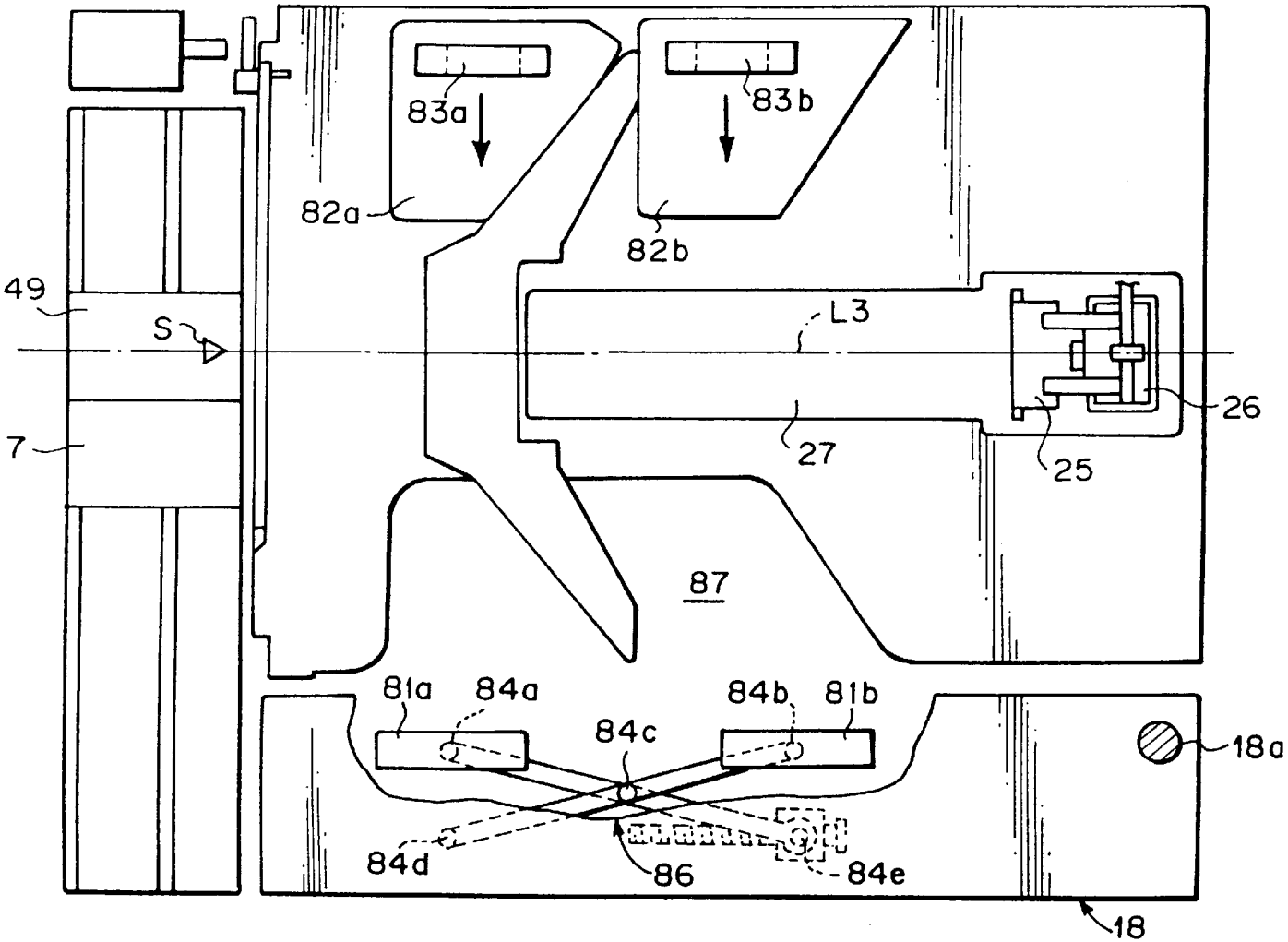
FIG. 12 is a schematic plan view of a sheet sorter with a stapler in accordance with a second embodiment of the present invention.

A sheet sorter with a stapler in accordance with a second embodiment of the present invention will be described with reference to FIGS. 12 to 14, hereinbelow. In the second embodiment, the elements analogous to those in the first embodiment are given the same reference numerals and will not be described here. The stapler 7 and the reciprocal sheet pusher mechanism 49 are the same as those in the first embodiment and will not be described here.

In the first embodiment described above, the sheets 2 are lined up with each other by bringing one side edges thereof in alignment with the side edge reference surface L1 irrespective of the size of the sheets 2, and accordingly the reciprocal pusher member 61 must be moved to the middle of the trailing edge of the sheet stack 20 the position of which varies according to the size of the sheets 2 as described above in conjunction with FIGS. 9A to 9D.

To the contrast, in the second embodiment, the sheets 2 are lined up by bringing the longitudinal axes of the sheets 2 into alignment with a center line L3. That is, as shown in FIG. 12, a pair of side lineup rods 81*a* and 81*b* which are rectangular in cross-section are provided near the sheet take-out doors 18 of the bins 4 to extends through the plurality of bins 4. Each bin 4 is provided with a wide cutaway portion 87 and the side lineup rods 81*a* and 81*b* are movable in the cutaway portion 87. Another pair of side lineup rods 83*a* and 83*b* are provided near the side edges of the bins 4 remote from the door 18. The side lineup rods 83*a* and 83*b* extends through openings 82*a* and 82*b* formed in the respective bins 4.

The guide rail 26, the sheet stack ejector 25 and the opening 27 in which the guide rail 26 and the sheet stack ejector 25 are moved are symmetrical about the center line L3.

Figure 13:
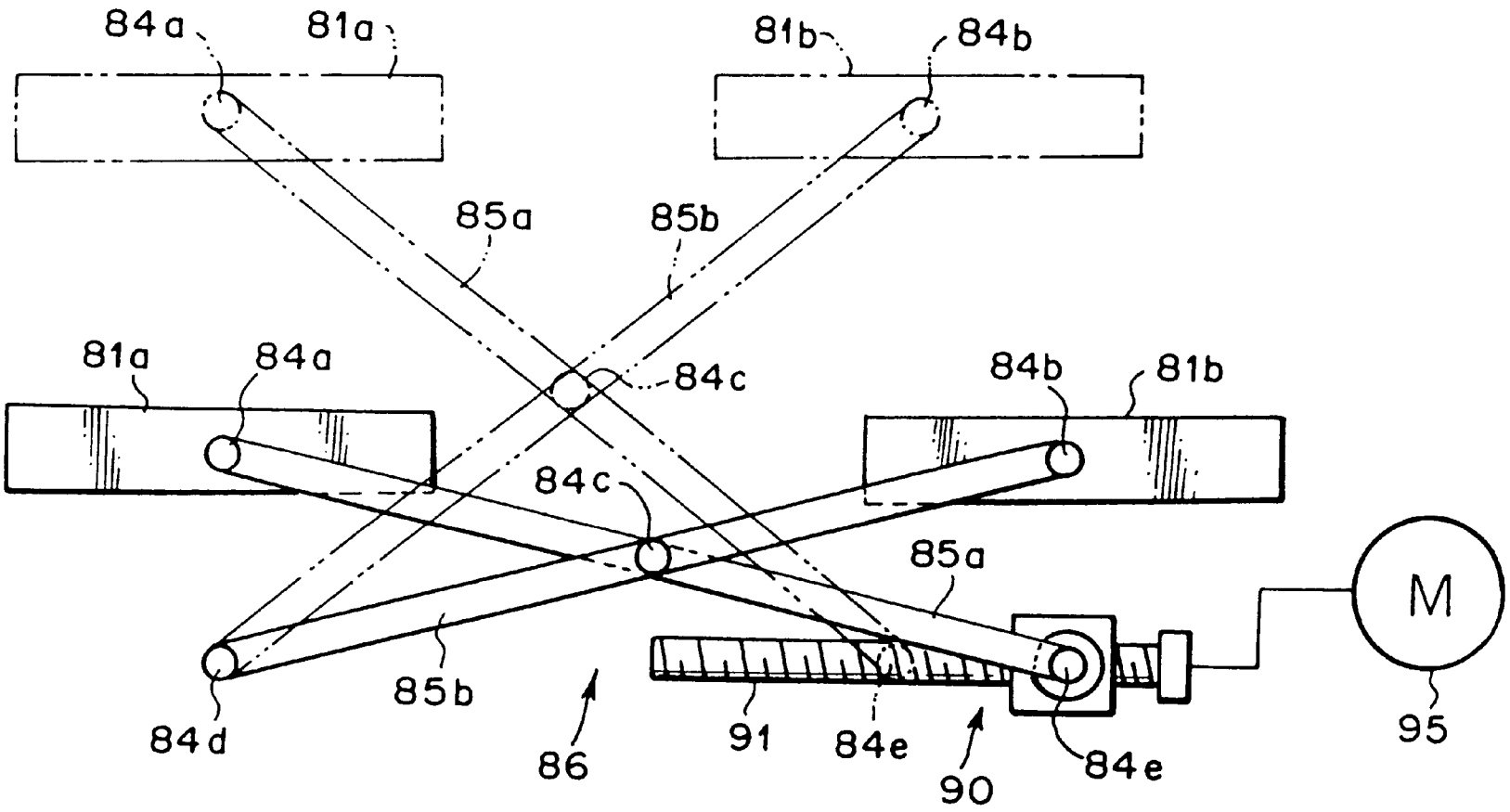
FIG. 13 is a schematic plan view showing the link of the side lineup rods.
Figure 14:
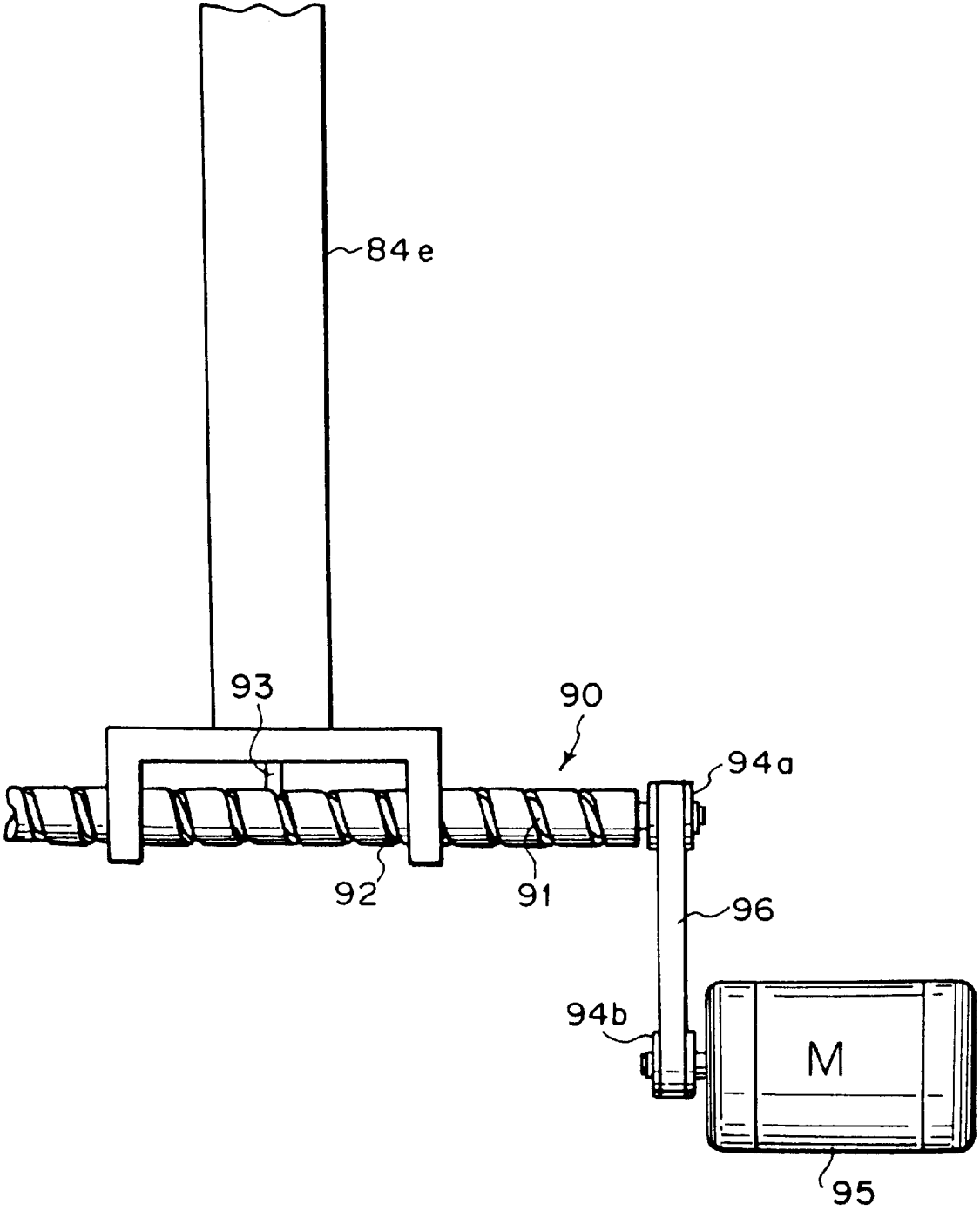
FIG. 14 is a side view showing the drive mechanism of the movable shaft of the link of the side lineup rods shown in FIG. 13.

AS shown in FIG. 13, the side lineup rods 81*a* and 81*b* near the door 18 are supported by a link mechanism 86 including upper and lower pairs of connecting rods 85*a* and 85*b* which are equal to each other in length.

The upper pair of connecting rods 85*a* and 85*b* are connected for rotation to the upper end portions of the respective side lineup rods 81*a* and 81*b* by way of shafts 84*a* and 84*b* at their one ends, and the lower pair of connecting rods 85*a* and 85*b* are connected to the lower end portions of the respective side lineup rods 81*a* and 81*b* by way of shafts 84*a* and 84*b* at their one ends. The other ends of the upper and lower connecting rods 85*a* are connected for rotation to a vertical shaft 84*e* disposed between the side lineup rod 81*b* and the door 18 and the other ends of the upper and lower connecting rods 85*b* are connected for rotation to a vertical shaft 84*d* disposed between the side lineup rod 81*a* and the door 18. Each of the upper and lower pair of connecting rods 85*a* and 85*b* are supported for rotation on a shaft 84*c* at the middles thereof. The shaft 84*d* is stationary and the shaft 84*e* is movable left and right as seen in FIG. 13.

As the movable shaft 84*e* is moved leftward, the side lineup rods 81*a* and 81*b* are moved toward the center line L3 and as the movable shaft 84*e* is moved rightward, the side lineup rods 81*a* and 81*b* are moved away from the center line L3.

With the arrangement of the link mechanism 86, as the movable shaft 84*e* is moved leftward, the shaft 84*a* is moved toward the centerline L3 along a linear line perpendicular to the center line L3 while the shaft 84*b* is moved toward the center line L3 approaching the shaft 84*a*. That is, as the side lineup rods 81*a* and 81*b* are moved toward the center line L3, the side lineup rod 81*b* moves toward the side lineup rod 81*a*, whereby the side lineup rods 81*a* and 81*b* can act on sheets of various sizes.

The movable shaft 84*e* is moved in parallel to the center line L3 by a shaft drive mechanism 90. As shown in FIG. 14, the shaft drive mechanism 90 comprises a guide rod 91 which extends in parallel to the center line L3 and is rotatable about its longitudinal axis. A lead screw 92 is formed on the outer surface of the guide rod 91 and an engagement pin 93 fixed to the lower end of the movable shaft 84*e* is in mesh with the lead screw 92. A driven pulley 94*a* is fixed to one end of the guide rod 91 coaxially with the guide rod 91 and a driving pulley 94*b* is fixed to an output shaft of a motor 95 which can be rotated in two directions. A driving belt 96 is passed around the pulleys 94*a* and 94*b*.

When the motor 95 rotates in one direction, the movable shaft 84*e* is moved leftward to move the side lineup rods 81*a* and 81*b* toward the center line L3 and when the motor 95 rotates in the other direction, the movable shaft 84*e* is moved rightward to move the side lineup rods 81*a* and 81*b* away from the center line L3.

The side lineup rods 83*a* and 83*b* on the side of the center line L3 opposite to the side lineup rods 81*a* and 81*b* are moved toward and away from the center line L3 by a drive mechanism (not shown) in synchronization with the side lineup rods 81*a* and 81*b*, whereby the longitudinal axes of the sheets 2 are brought into alignment with the center line L3 irrespective of the size of the sheets 2.

Accordingly, when the stapled sheet stack 20 is to be pushed back into the bin 4, the reciprocal pusher member 61 may be moved to the same position, where it is aligned with the center line L3, irrespective of the size of the sheets 2. Symbol S in FIG. 12 denotes a sensor which detects that the reciprocal pusher member 61 is in alignment with the center line L3. Thus also in this embodiment, the sheet stack 20 can be pushed back into the bin 4 straight.

Further in this embodiment, since the reciprocal sheet pusher mechanism 49 is moved to the same position irrespective of the size of the sheets 2, position control of the base table 50 on which the stapler 7 and the reciprocal sheet pusher mechanism 49 are mounted is simplified.

Also in this embodiment, the side lineup rods 81*a*, 81*b*, 83*a* and 83*b* may be slightly retracted away from the side edges of the sheet stack 20 by moving rightward the movable shaft 84*e* to assist the reciprocal sheet pusher mechanism 49 in pushing back the sheet stack 20 into the bin 4 straight.

In the embodiments described above, the reciprocal pusher member 61 is provided with the vertical surface 61*a* which is flat. However the vertical surface 61*a* may be divided into a plurality of vertical surface portions which are flush with each other and are arranged in the direction of width of the sheets. Further a plurality of pusher members 61 may be provided to form an array. In this case, the pusher members 61 are arranged in the direction of width of the sheets so that their vertical surfaces 61*a* are in flush with each other and are centered to the trailing edge of the sheet stack so that the middle of the array is brought into alignment with the center line of the sheet stack. In this specification, the term "a single reciprocal pusher member" should be broadly interpreted to include such an array of two or more reciprocal pusher members.

What is claimed is:

1. A sheet sorter with a stapler comprising a plurality of bins arranged in a vertical direction each of which receives a plurality of sheets discharged from an image recording apparatus and forms thereon a stack of sheets, a sheet transfer means which transfers the sheets discharged from the image recording apparatus, an indexer which is movable up and down along the array of sheet inlet ends of the bins to distribute the sheets from the sheet transfer means to the respective bins through the sheet inlet ends thereof, and a stapler which is movable up and down along the array of the sheet inlet ends of the bins and in a direction of width of the sheets to staple the stack of sheets on each bin which has been ejected beyond the sheet inlet end of the bin by a predetermined length wherein the improvement comprises a reciprocal pusher member which is provided on and movable with the stapler and actuated after completion of stapling by the stapler for pushing the stapled stack of sheets back to the bin and a centering means which moves the reciprocal pusher member to a position substantially opposed to the middle of the trailing edge of the stack of sheets after stapling by the stapler.

2. A sheet sorter with a stapler as defined in claim 1 further comprising a lineup means for lining up the edges of the sheets in the stack on each bin.

3. A sheet sorter with a stapler as defined in claim 2 in which the lineup means comprises a side lineup member which pushes one side edges of the sheets to bring the other side edges of the sheets into abutment against a predetermined side edge reference surface so that said the other side edges are brought into alignment with each other on the reference surface, and the side lineup member is slightly retracted away from said one side edges of the sheets before the reciprocal pusher member is actuated after completion of stapling by the stapler.

4. A sheet sorter with a stapler as defined in claim 3 in which the side edge reference surface of each bin is defined by the inner surface of a sheet take-out door of the sorter when the door is closed.

5. A sheet sorter with a stapler as defined in claim 2 in which the lineup means comprises a pair of lineup members which are opposed to each other in the direction of width of the sheets and are movable toward and away from each other on opposite sides of the sheets, the lineup members are moved toward each other to push the respective side edges of the sheet to hold the longitudinal axis of the sheet in alignment with a predetermined reference line irrespective of the size of the sheet, and the lineup members are slightly retracted away from the side edges of the stack of sheets before the reciprocal pusher member is actuated after completion of stapling by the stapler.

* * * * *